United States Patent [19]

Frobose

[11] 4,221,430

[45] Sep. 9, 1980

[54] PUSH BUTTON ADJUSTER FOR CHAIR BACKREST

[75] Inventor: James W. Frobose, Haskins, Ohio

[73] Assignee: Jasper Corporation, Marshalltown, Iowa

[21] Appl. No.: 906,918

[22] Filed: May 18, 1978

[51] Int. Cl.[2] ..... A47C 1/00

[52] U.S. Cl. ..... 297/353; 297/410; 403/324; 403/325

[58] Field of Search ..... 297/353, 358, 364, 365, 297/410, 296–301; 403/108, 109, 322, 324, 325

[56] References Cited

U.S. PATENT DOCUMENTS

| | | | |
|---|---|---|---|
| 3,295,888 | 1/1967 | Poland | 297/298 |
| 3,326,602 | 6/1967 | Moore et al. | 297/353 |
| 3,526,430 | 9/1970 | Eldon | 297/353 |

FOREIGN PATENT DOCUMENTS

| | | | |
|---|---|---|---|
| 531413 | 7/1931 | Fed. Rep. of Germany | 248/408 |
| 1371641 | 10/1974 | United Kingdom | 297/353 |

*Primary Examiner*—William E. Lyddane
*Attorney, Agent, or Firm*—Brady, O'Boyle & Gates

[57] ABSTRACT

A low cost, highly convenient, and non-complicated push button adjuster for chair backrests eliminates bulky and unsightly protruding levers, hand wheels and other external operators. A simple push button normally flush with the rear face of a backrest is depressed to shift a connected locking pin out of a detent slot in a backrest support bar so that the backrest is released for height adjustment. The push button and locking pin are spring-biased to the active locking position.

10 Claims, 6 Drawing Figures

PUSH BUTTON ADJUSTER FOR CHAIR BACKREST

BACKGROUND OF THE INVENTION

Height adjustable backrests are commonly employed on secretarial chairs or the like, and a variety of backrest adjusting and locking mechanisms for such backrests are known in the prior art. In most instances, the prior art adjusters are fairly costly and commonly have protruding knobs, operating levers and the like which are somewhat unsightly and sometimes inconvenient. Some examples of the prior art are shown in the below-listed U.S. patents which are made of record herein to comply with the duty to disclose known prior art under 37 C.F.R. 1.56, U.S. Pat. Nos.:

2,054,557
3,326,602
3,351,379
3,526,430
3,854,772
4,012,158
4,043,594.

The objective of the invention is to provide a chair backrest adjuster which is entirely free of the above-noted deficiencies of the prior art, and which is considerably less costly to manufacture, more convenient to use, and provides a much better finished appearance on the chair which employs the invention. A further attribute of the present invention resides in a simpler and less costly assembly procedure for the backrest which is equipped with the push button adjuster in accordance with the invention.

Other features and advantages of the invention will appear to those skilled in the art during the course of the following description.

DETAILED DESCRIPTION

Figure 2:
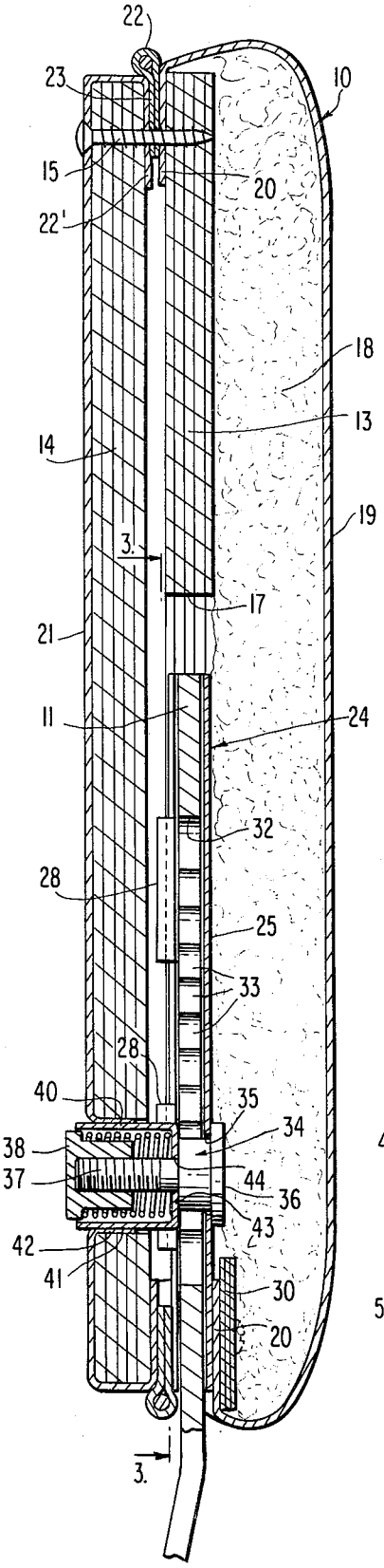
FIG. 2 is an enlarged central vertical section taken through the backrest and adjuster on line 2—2 of FIG. 1.
Figure 1:
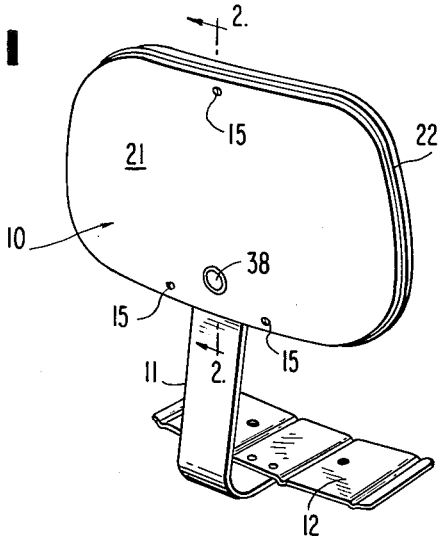
FIG. 1 is a rear perspective view of a chair backrest equipped with the push button adjuster embodying the invention.
Figure 3:
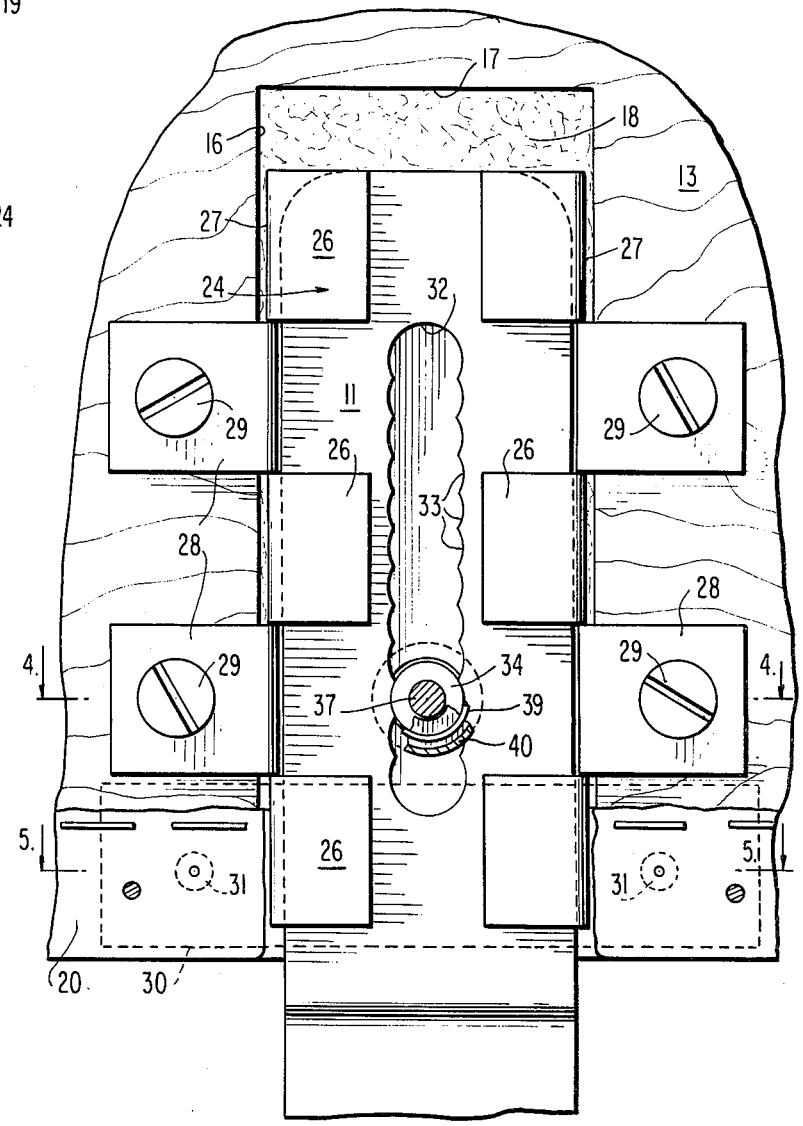
FIG. 3 is a fragmentary vertical section through the backrest taken on the plane of line 3—3 of FIG. 2.

Referring to the drawings in detail wherein like numerals designate like parts, the numeral 10 designates a fabric covered padded backrest for a secretarial chair which is attached for height adjustment by means of the present invention to an upright backrest support bar 11 carrying an anchor plate 12 at its lower end for attachment to a chair seat, not shown.

The backrest 10 comprises separate forward and rear plywood panels 13 and 14, the rear panel 14 being removably attached to the forward panel 13 preferably by three wood screws 15 near the top and bottom edges of the backrest. The forward plywood panel 13 has a vertically extending rectangular slot 16 formed through its lower edge at its transverse center and having an upper horizontal end wall 17 disposed somewhat above the vertical center of the backrest 10. Forwardly of the plywood panel 13, the adjustable backrest has padding 18 of any preferred type and this padding is covered and enclosed by a fabric section 19 which defines the forward face of the backrest 10. The marginal edge of the fabric section 19 extends to the rear face of panel 13 to form a relatively narrow portion 20 which may be stapled to the panel 13.

The rear removable plywood panel 14 is covered on its rear face with fabric 21 which is also lapped about the edges and front face of the panel 14 to form a fabric portion 22' facing the portion 20 and stapled to the forward face of panel 14. A finishing bead 22 of fabric extends around the margin of the backrest 10 with extensions 23 thereof clampingly engaged between the two panels 13 and 14.

A sturdy metal bracket 24 is utilized to connect the backrest 10 adjustably to the upright support bar 11. This bracket includes a flat forward wall 25 disposed immediately forwardly of the bar 11 and longitudinally spaced pairs of rear flat flanges 26 which lie in a common plane parallel to the wall 25 and spaced rearwardly thereof. The flanges 26 of bracket 24 lap the back of support bar 11 and constitute with the wall 25 and connecting edge portions 27 of the bracket a flattened sleeve body which slidably embraces the bar 11. Opposite side outwardly extending flat tabs 28 on the metal bracket 24 are anchored by screws 29 to the rear face of plywood panel 13. In this manner, the bracket 24 constitutes a support for the entire backrest 10 enabling it to be adjusted upwardly or downwardly on the support bar 11 in a manner to be further described. The upper end wall 17 of the slot 16 in panel 13 provides a limit stop for the downward movement of the backrest 10 on the support bar 11.

Figure 5:
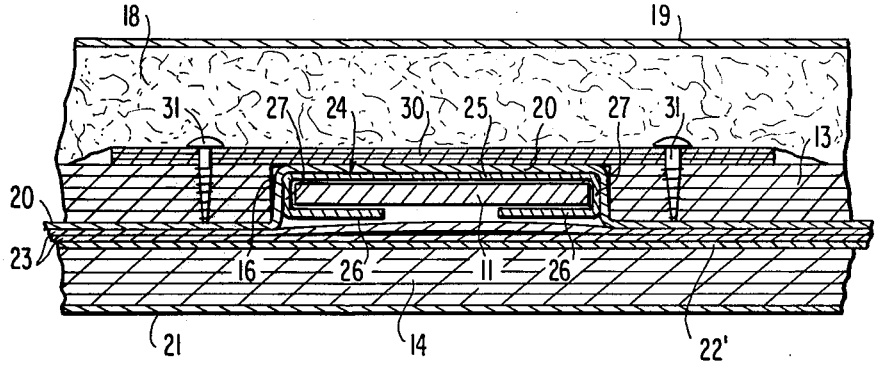
FIG. 5 is a fragmentary horizontal section taken on line 5—5 of FIG. 3.
Figure 6:
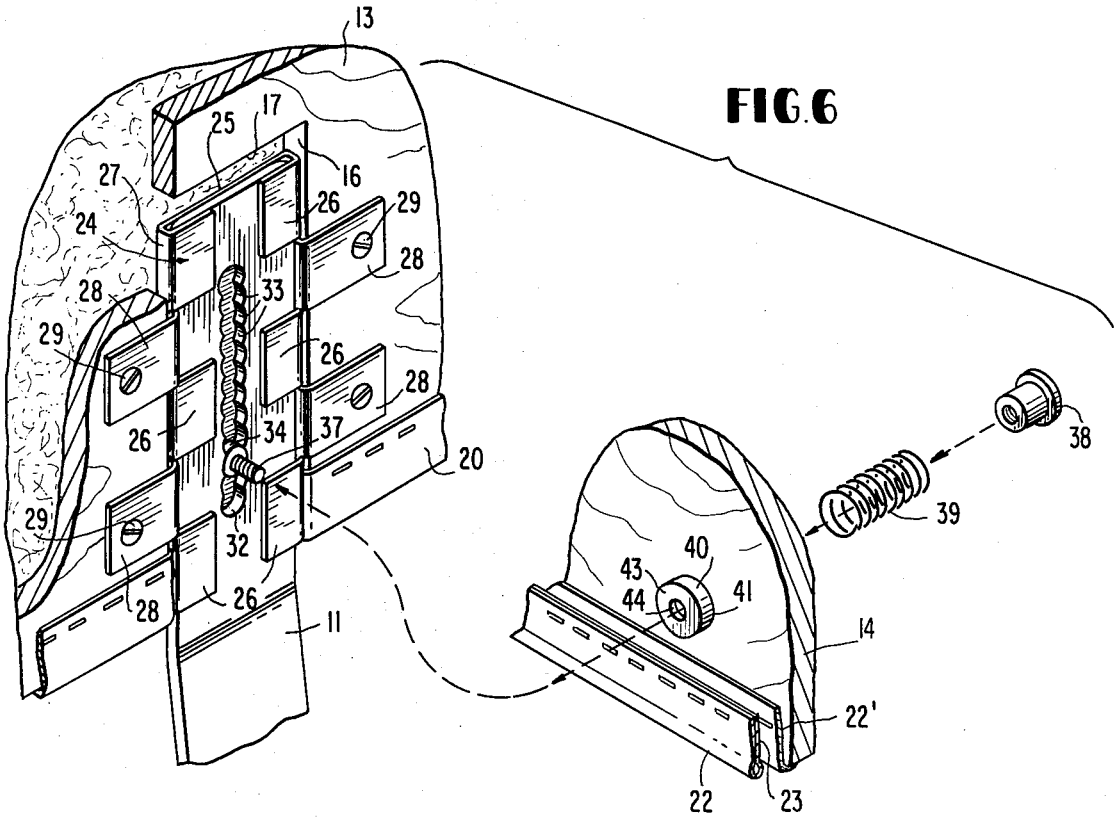
FIG. 6 is a fragmentary exploded perspective view of the invention, partly in cross section.

A plywood bridging strip 30, FIGS. 2 and 5, is preferably placed across the bottom of the rather wide slot 16 and anchored to the front face of panel 13 by a pair of screws 31. This bridging strip 30 provides a ready means of clamping the narrow fabric portion 20 against the forward wall 25 of bracket 24 in the region where such fabric would otherwise be unsupported due to the presence of the slot or cut-out 16.

To form the height adjusting means for the backrest 10 according to the main feature of the invention, the support bar 11 is provided with a central vertically elongated adjusting slot 32 having a series of independent cylindrically curved detent recesses 33 formed along its length. These detent recesses 33 provide multiple height adjustment positions for the backrest 10. In cooperation with the adjusting slot 32, a horizontal axis adjusting and locking pin 34 of cylindrical formation is adapted for selective engagement in the detent recesses 33 along the slot 32. The pin 34 is received through an aperture 35 in the wall 25 of bracket 24 and has a flat head 36 which lies immediately rearwardly of the wall 25, FIGS. 2 and 4. The pin 34 has a rearwardly projecting screw-threaded shank 37 of reduced diameter which is threadedly engaged with a push button 38 normally biased by a coil spring 39 into a position where the push button is approximately flush with the rear face of the backrest 10 or protruding slightly therefrom, as shown in FIG. 2. Push button 38 and biasing spring 39 are received within a cylindrical cup 40, which cup is snugly fitted within an opening 41 of the plywood panel 14 and fixed therein along with surrounding fabric 42 by cementing or the like. The cup 40 has a forward end wall 43 which substantially abuts the rear face of support bar 11 and the end wall 43 has a central aperture 44 formed therethrough providing further axial guidance for the adjusting the locking pin 34. The biasing spring 39 normally holds the head 36 of pin 34 in abutment with the bracket forward wall 25.

Figure 4:
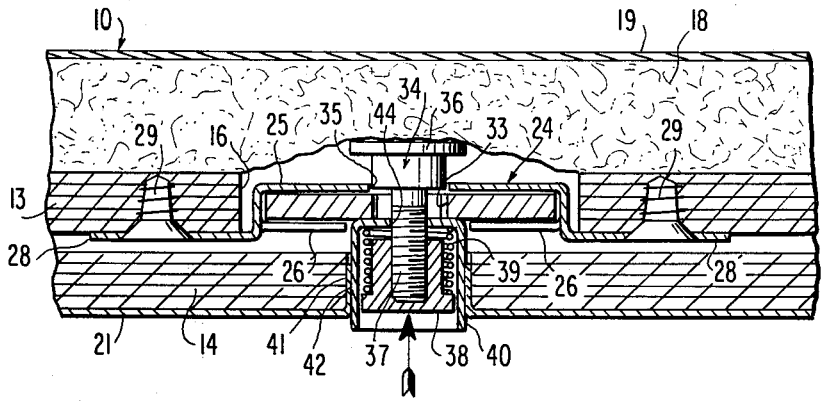
FIG. 4 is a fragmentary horizontal section taken on line 4—4 of FIG. 3.

In the use of the adjuster to regulate the height of the backrest 10, it is merely necessary to press the button 38 forwardly into the cup 40 against the spring 39, as illustrated in FIG. 4. This will cause the cylindrical body of pin 34 to move forwardly and out of engagement with the particular detent recess 33 in which it is seated, the axial length of the pin body being about equal to the thickness of the bar 11 plus the thickness of the bracket wall 25. When the pin 34 is thus thrust forwardly, it enters the cushioning material 18 which yields and offers no significant resistance to the movement of the pin. With the pin 34 out of the adjusting slot 32, the backrest 10 can be freely adjusted upwardly or downwardly on the bar 11, the bracket 24 offering smooth guidance of the backrest on the support bar 11. Following the removal of finger pressure on the push button 38, the locking and positioning pin 34 may enter any selected adjustment recess 33 of the bar 11 to securely hold the backrest 10 in the selected adjusted position.

It may now be seen that the operation of the backrest adjuster is very simple and convenient. There are no levers to tilt or knobs to turn and no awkward parts of the mechanism protrude from the backrest. A great virtue of the structure is that the bracket 24 and all associated parts other than the push button 38 are concealed internally in the padded backrest, thus making for a very clean and uncluttered appearance which is extremely important in furniture. The construction of the invention is also durable, simplified, virtually foolproof in operation, and economical to manufacture. Its many advantages over the prior art should now be apparent.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In an adjustable height chair backrest structure, a backrest support bar having multiple vertically spaced detent means, a bracket movably engaging said support bar and adapted for movement upwardly and downwardly thereon, a backrest anchored to the bracket fixedly and being movable therewith on said support bar, a rearward panel for the backrest, a locking and positioning pin for the backrest having a movement axis substantially at right angles to said support bar and adapted when in an active position to engage said detent means to releasably lock the backrest in a selected height adjusted position, a retaining cup anchored within an opening in said rearward panel and having a guide for said locking and positioning pin, yielding means in said retaining cup and connected with said pin biasing it to said active position, said bracket, locking and positioning pin, and yielding means being disposed internally of the backrest and rearward panel and concealed therein, and a push button operator for said pin extending in the opening and being visible on the rear side of the rearward panel and being operable against the force of said yielding means to shift said pin clear of engagement with said detent means whereby the backrest may be adjusted upwardly or downwardly on said support bar.

2. In an adjustable height chair backrest structure as defined in claim 1, and said detent means comprising a substantially vertical slot in said support bar having plural detent recesses along the slot selectively engageable with the locking and positioning pin when the pin is in said biased active position.

3. In an adjustable height chair backrest structure as defined in claim 1, and said backrest comprising a fabric covered backrest having padding at least on its forward side, a first substantially rigid panel disposed internally of the backrest behind said padding and forming the anchoring means for said bracket and having a cut-out portion adjacent to the support bar allowing vertical movement of the backrest relative to the support bar, and said rearward panel for the backrest disposed rearwardly of said first panel and detachably secured thereto and being fabric covered at least on its rear side and marginal edge portions, the rearward panel defining the rear face of the backrest and the opening formed therethrough in registry with said push button operator to provide access to such operator at the rear face of the backrest.

4. In an adjustable height chair backrest structure as defined in claim 1, and said detent means comprising a notched edge portion on said support bar extending lengthwise thereof, and individual notches along said edge portion being selectively engageable with said biased locking and positioning pin.

5. In an adjustable height chair backrest structure as defined in claim 1, and said bracket including a sleeve body embracing said support bar and having anchoring tabs extending therefrom on opposite sides of the support bar for rigid attachment to an internal panel of the backrest, said panel having a vertical slot formed therethrough and receiving said support bar and sleeve body of the bracket, said slot having a top wall forming a limit stop to limit downward adjustment of the seat back relative to the support bar.

6. In an adjustable height chair backrest structure as defined in claim 5, and said rearward panel being detachable from said backrest and positioned rearwardly of said support bar and said bracket, and the opening for said retaining cup and push button operator and said pin on an axis substantially at right angles to the longitudinal axis of said support bar.

7. In an adjustable height chair backrest structure as defined in claim 5, and said bracket comprising a unitary sheet metal bracket having a forward wall and rear side flanges lying in a common plane rearwardly of said forward wall to form a flattened sleeve body on said bracket through which said support bar extends movably, said support bar comprising a relatively thin flat plate-like bar.

8. In an adjustable height chair backrest structure as defined in claim 7, and said detent means comprising a multiple recessed vertical slot in said support arm between said flanges of the bracket sleeve body, and the forward wall of said bracket sleeve body having an opening for said locking and positioning pin in alignment with said vertical slot.

9. In an adjustable height chair backrest structure, a backrest support bar having multiple vertically spaced detent means, a bracket movably engaging said support bar and adapted for movement upwardly and downwardly thereon, a backrest anchored to the bracket fixedly and being movable therewith on said support bar with the bracket disposed internally of the backrest and concealed therein, a rearward panel for the backrest, a locking and positioning pin for the backrest having a movement axis substantially at right angles to said support bar and adapted when in an active position to engage said detent means to releasably lock the backrest in a selected height adjusted position, said locking and positioning pin having a head disposed forwardly of a front wall of said bracket, said front wall having a guide opening for the body portion of said pin, a reduced diameter extension on the rear of said pin, a coil spring surrounding said extension and connected with said pin biasing it to said active position, a retaining cup for said spring anchored within an opening in said rearward panel and having a cup end wall guide opening for said reduced diameter extension of the pin in coaxial relationship with said guide opening for said pin in said front wall of said bracket, and a push button operator connected on said extension and accessible at the rear side of the rearward panel and being operable against the force of said spring to shift said pin clear of engagement with said detent means whereby the backrest may be adjusted upwardly or downwardly on said support bar.

10. In an adjustable height chair backrest structure as defined in claim 9, and said push button operator having a rear end head closely engageable within said cup, and said coil spring having one end bearing on the interior side of the head of the push button operator and another end bearing on said cup end wall, the head of the push button operator being the only element of the chair backrest adjusting mechanism exposed and visible on the exterior of the backrest.

* * * * *